United States Patent [19]

Gustafson

[11] Patent Number: 5,052,692

[45] Date of Patent: Oct. 1, 1991

[54] SYSTEM FOR TEACHING THE ART OF ANIMAL EXHIBITION

[76] Inventor: Richard Gustafson, 941 S. Skagit St., Burlington, Wash. 98233

[21] Appl. No.: 493,883

[22] Filed: Mar. 15, 1990

[51] Int. Cl.[5] ..... A63F 3/00

[52] U.S. Cl. ..... 273/249

[58] Field of Search ..... 273/242, 243, 248, 249, 273/256, 257, 278, 279

[56] References Cited

U.S. PATENT DOCUMENTS

| | | | |
|---|---|---|---|
| 1,536,672 | 5/1925 | Hobbs | 273/249 |
| 3,582,080 | 6/1971 | Schick | 273/243 |
| 3,926,438 | 12/1975 | Breslow | 273/243 |
| 4,065,131 | 12/1977 | Martin | 273/243 |
| 4,124,214 | 11/1978 | Pavis | 273/249 |
| 4,279,422 | 7/1981 | Shaw | 273/243 X |
| 4,585,233 | 4/1986 | Wilson | 273/256 |
| 4,787,639 | 11/1988 | Ross | 273/249 |

*Primary Examiner*—Edward M. Coven
*Assistant Examiner*—William E. Stoll
*Attorney, Agent, or Firm*—James E. Jacobson, Jr.

[57] ABSTRACT

An improved method and system for instructing individuals as to the various breeds of animals and in the art of exhibition. An event board simulates true life circumstances which occur while exhibiting during a competition. Other devices are employed which instruct users as to the various aspects of exhibition and of dog breeds such that the information is presented in a manner which is enjoyable to the users. The game board indicia is presented in tracks or bands, with each band representing a different level of competition.

7 Claims, 11 Drawing Sheets

BUT I COULD HAVE WON
IF
The ground had been level
so my dog could walk.
FIG. 4A
WHINNERS
CARD
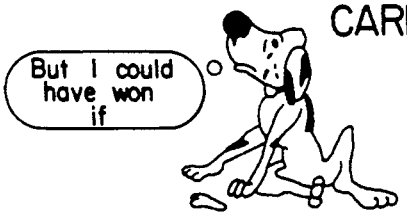
FIG. 4B
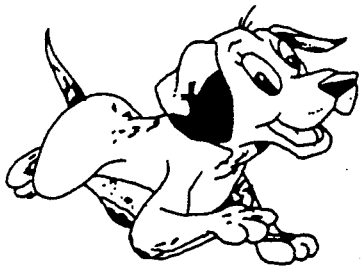
FIG. 5A
PET PUPPY
SELL FOR $250.00
AS YOU PASS
BEGINING SQUARE
FIG. 5B

INSURANCE
POLICY

INSURANCE
POLICY

This Policy will protect against loss of points. Once purchased player retains for duration of game.

RECEIVE ONE FREE
PET PUPPY

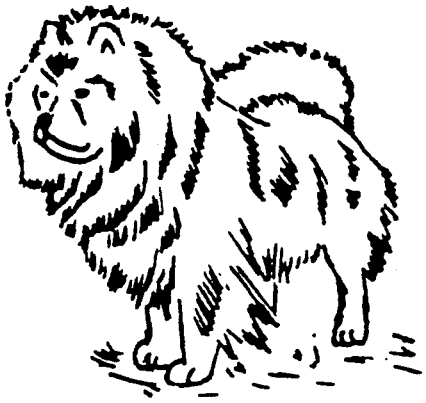
CHOW CHOW
FIG. 6A
NON-SPORTING GROUP
ORIGIN: CHINA
HEIGTH: 20"
WEIGHT: 60 LBS. AV.
FIG. 6B
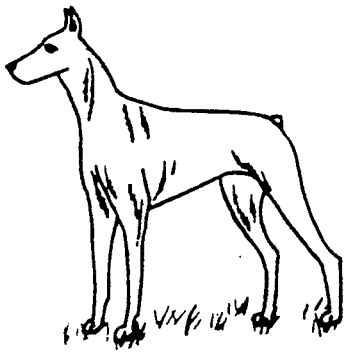
DOBERMAN PINSCHER
FIG. 6C
WORKING GROUP
ORIGIN: GERMANY
HEIGTH: 27"
WEIGHT: 70 LBS. AV.
FIG. 6D
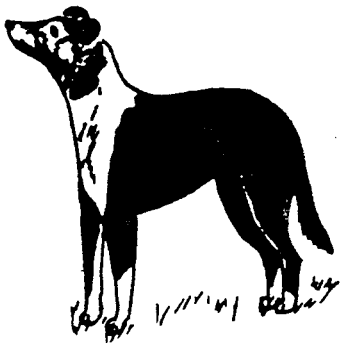
SMOOTH COLLIE
FIG. 6E
HERDING GROUP
ORIGIN: SCOTLAND
HEIGTH: 24"
WEIGHT: 65 LBS. AV.
FIG. 6F

SYSTEM FOR TEACHING THE ART OF ANIMAL EXHIBITION

TECHNICAL FIELD

This invention relates to the field of learning and entertainment, and more specifically to an improved method and means for teaching persons about various breeds of animals and the pitfalls of exhibiting the same.

BACKGROUND OF THE INVENTION

The exhibition of various types of animals such as dogs, horses, cats, rabbits, etc., has long been an activity enjoyed by many, but often spectators lack an understanding or appreciation of these events. For example, in a typical dog show, as many as 130 breeds of dogs may be exhibited, and each of these breeds may be exhibited in a variety of ways under a set of arcane rules which are understood by few. While many people may be interested in learning the details of exhibiting animals, it is extremely difficult to learn from exhibitors at these events, as they are occupied with other matters. In addition, there are few reference volumes available for novices, thus further restricting the available sources of information.

Furthermore, given the wide variety of available breeds, it is often difficult to determine which animal is best suited to a person's situation. This information is often not presented in forms which are easily understood.

Accordingly, no method or means is known for instructing individuals in the art of exhibiting animals while providing instruction as to the characteristics of various breeds, and presenting this information in a manner which is enjoyable and easy to understand.

SUMMARY OF THE INVENTION

In summary, the present invention contemplates a method and means of simulating an animal exhibition wherein a plurality of icons represent contestants in exhibition. The present invention includes a plurality of fact cards containing various facts about the art of animal exhibition and a playing board having a plurality of contiguous fields forming first and second bands arranged in a concentric array and at least one central field, wherein each of the fields represent an event which occurs at an animal exhibition, an event which occurs in the course of preparing for competition, or an instruction to the user to select one of the fact cards, wherein said icons are advanced around said bands based on some random criteria, wherein said second band represents an advanced level of competition and said central band represents the pinnacle of competition.

Accordingly, it is an object of the present invention to provide a method and means for educating individuals.

It is another object of the present invention to provide an improved method and means for instructing individuals in the art of exhibiting animals.

It is still another object of the present invention to provide an improved method and means for instructing individuals as to various breeds of animals.

BRIEF DESCRIPTION OF THE DRAWINGS

These and other objects may be readily understood through the description below and the accompanying Figures of drawings in which:

FIG. 4A and 4B are a series of diagrams of cards used to simulate the reaction of a contestant after receiving no points at a given event.

FIGS. 5A–5F are a series of drawings of cards used to simulate various situations or occurrences which may occur at an animal exhibition event.

FIGS. 6A–6F are a series of drawings of breed cards used to instruct users as to aspects of various breeds.

DETAILED DESCRIPTION OF THE INVENTION

Figure 1A:
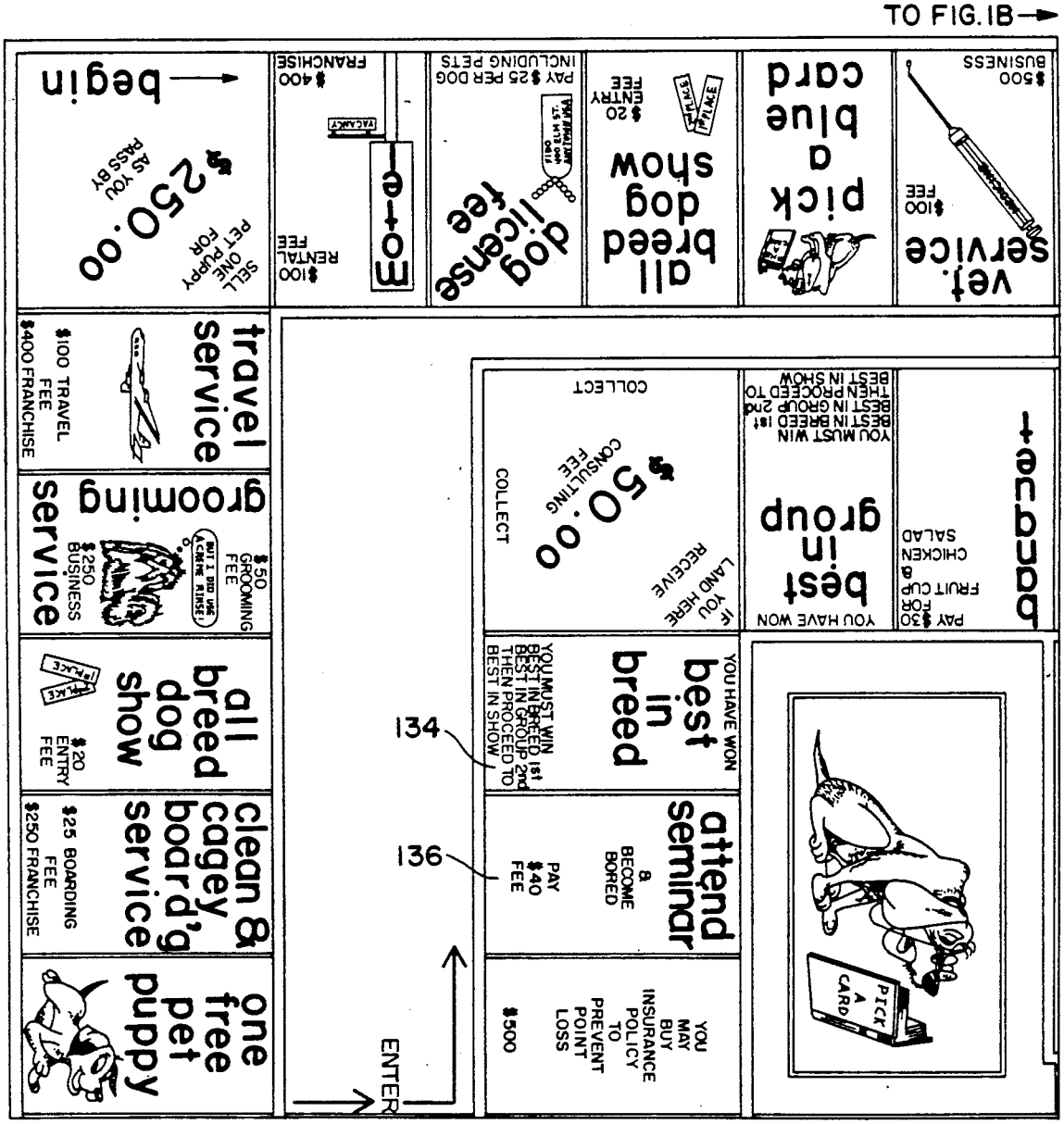
FIG. 1 is a top view of the event board used in association with the exhibition simulator of the present invention.
Figure 1B:
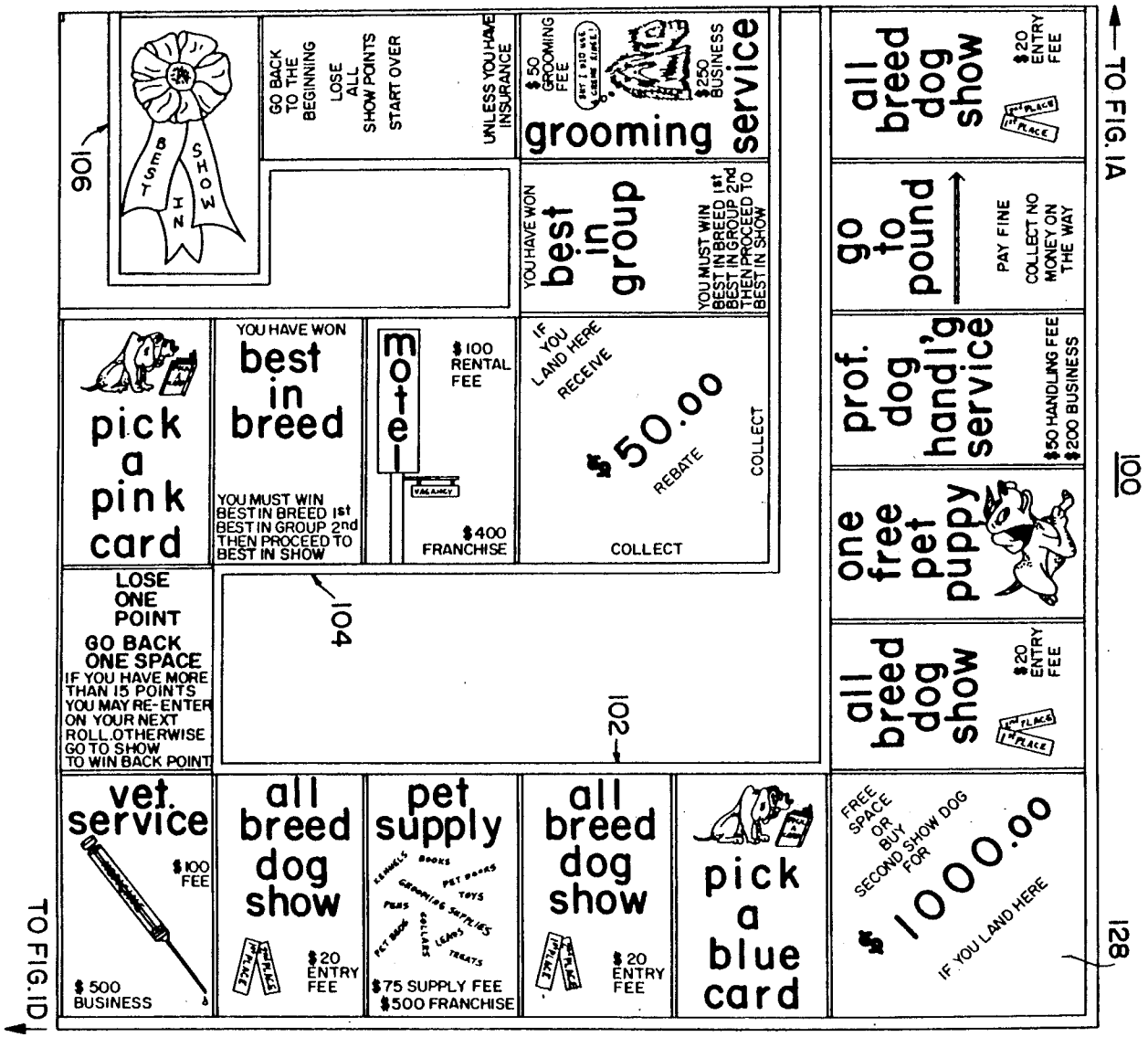
Figure 1C:
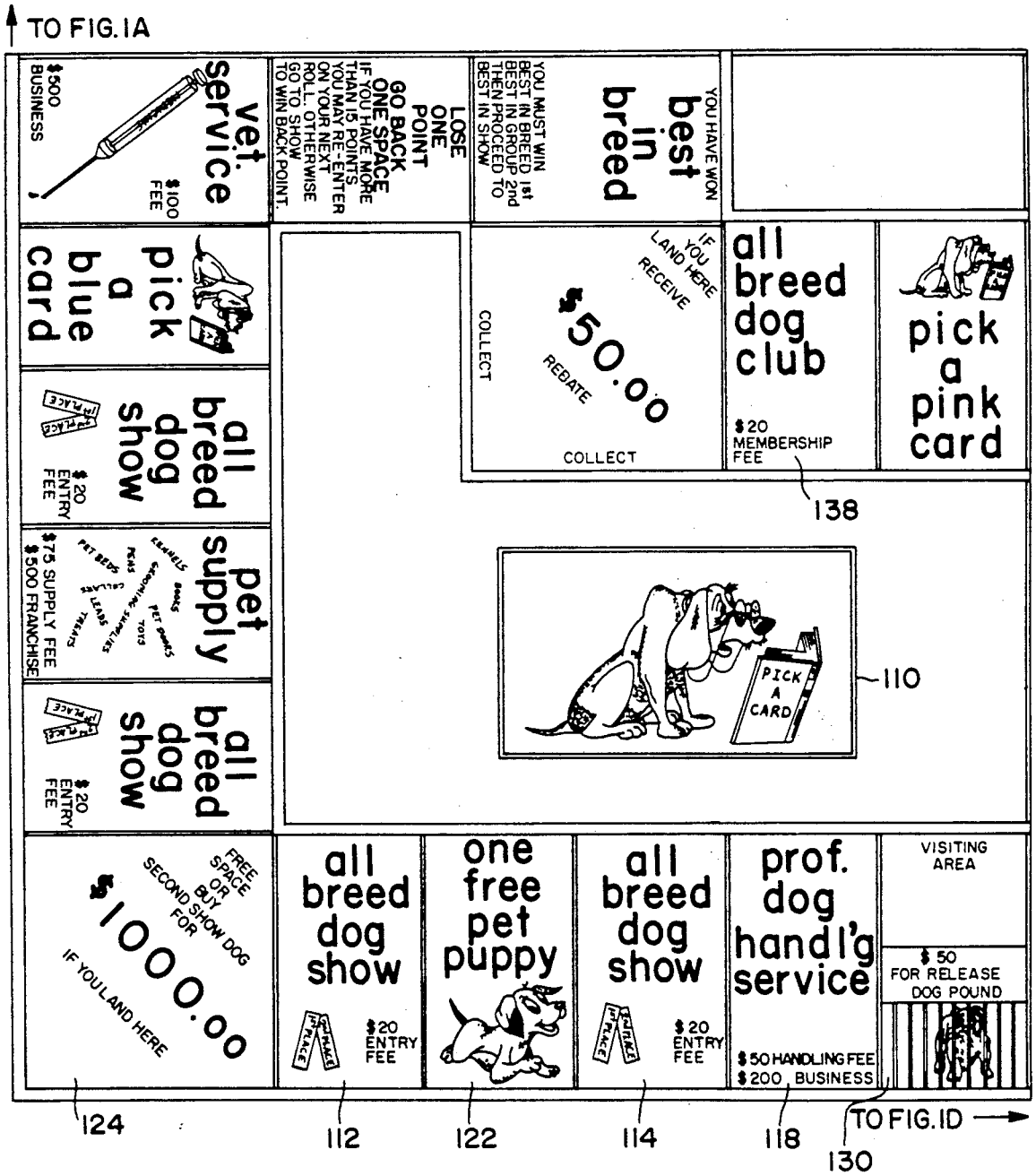
Figure 1D:
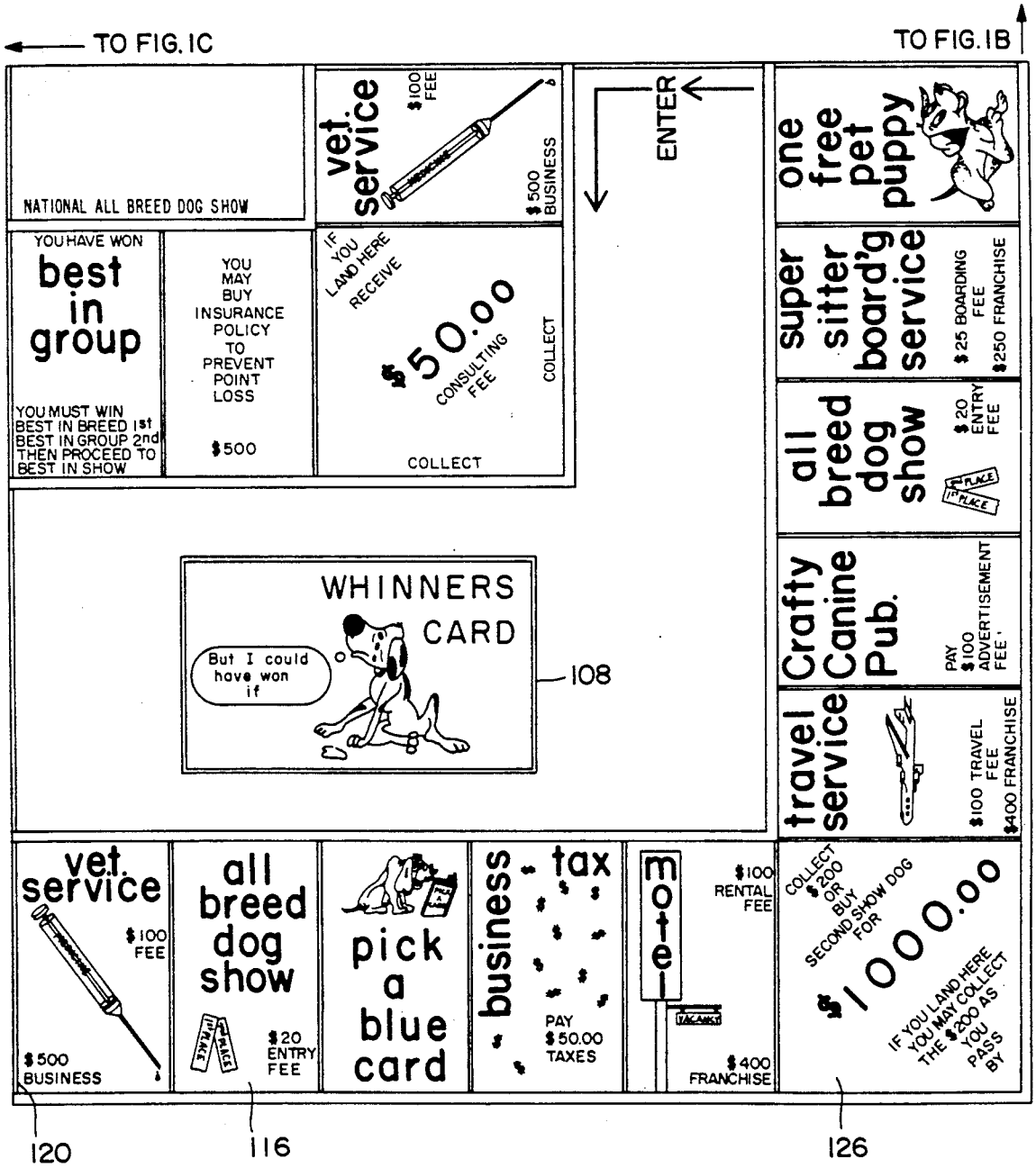
Figure 2A:
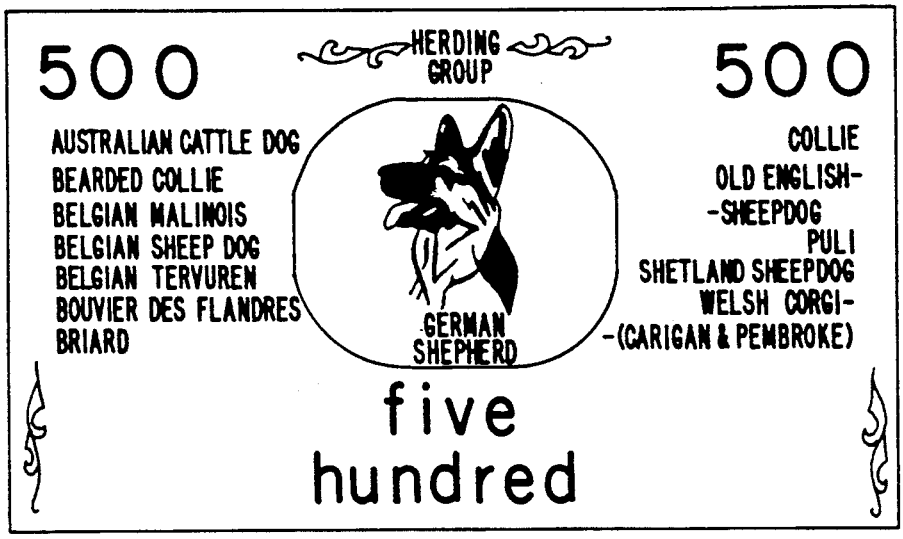
FIGS. 2A–2G are a series of diagrams detailing the denominations of "money" used to represent various groups of animals.
Figure 2B:
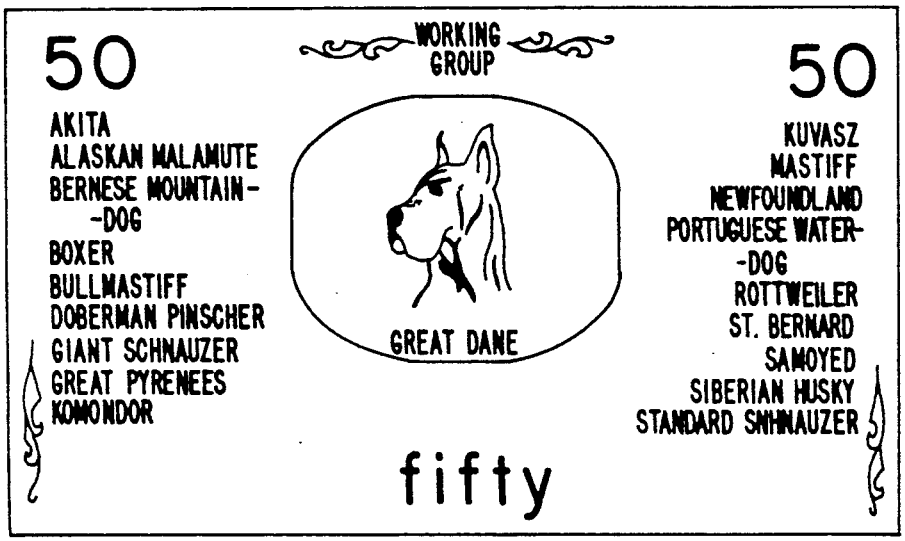
Figure 2C:
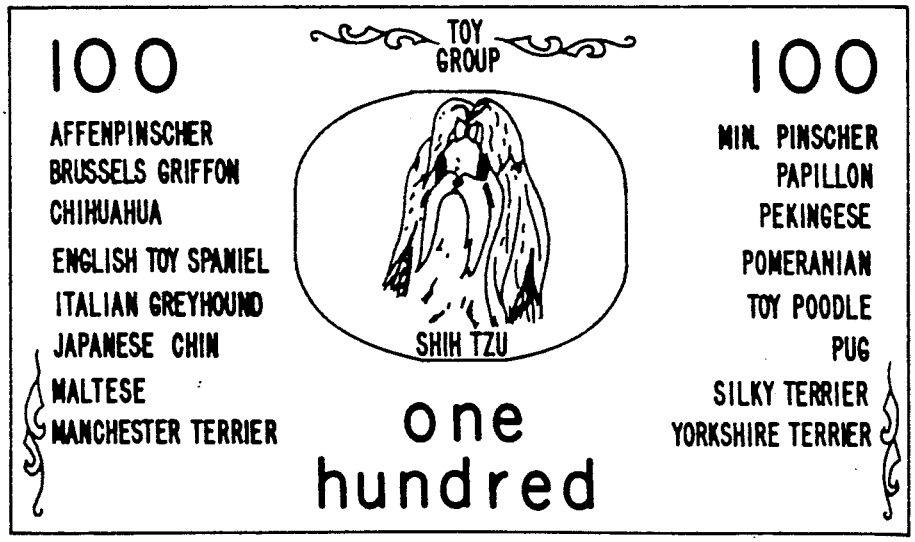
Figure 2D:
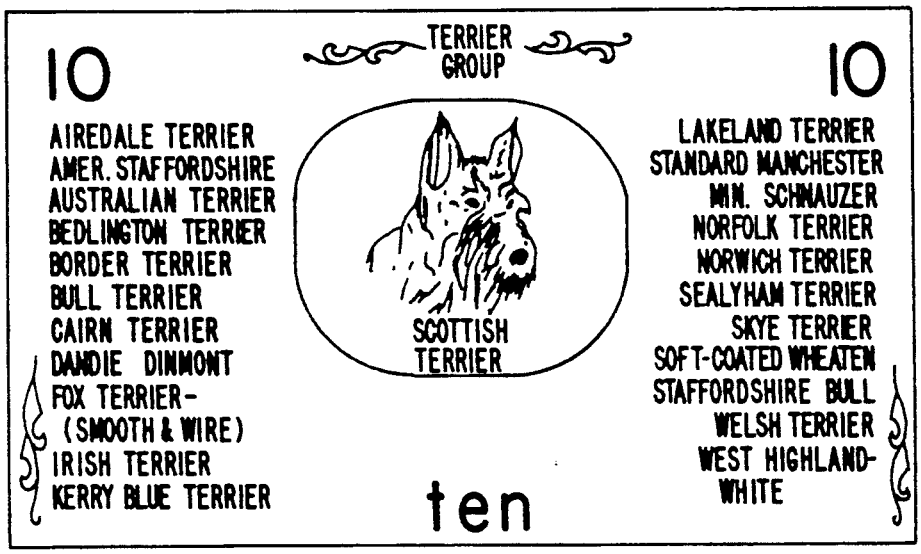
Figure 2E:
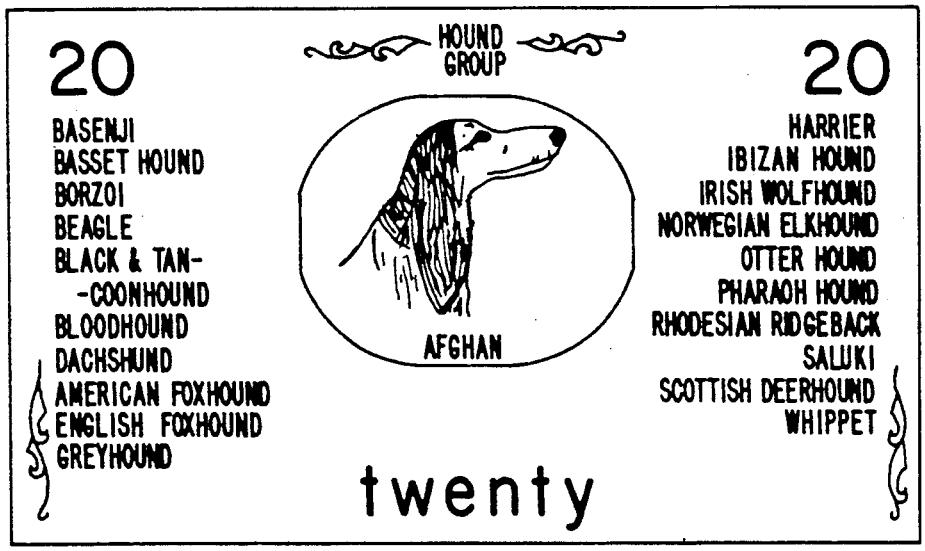
Figure 2F:
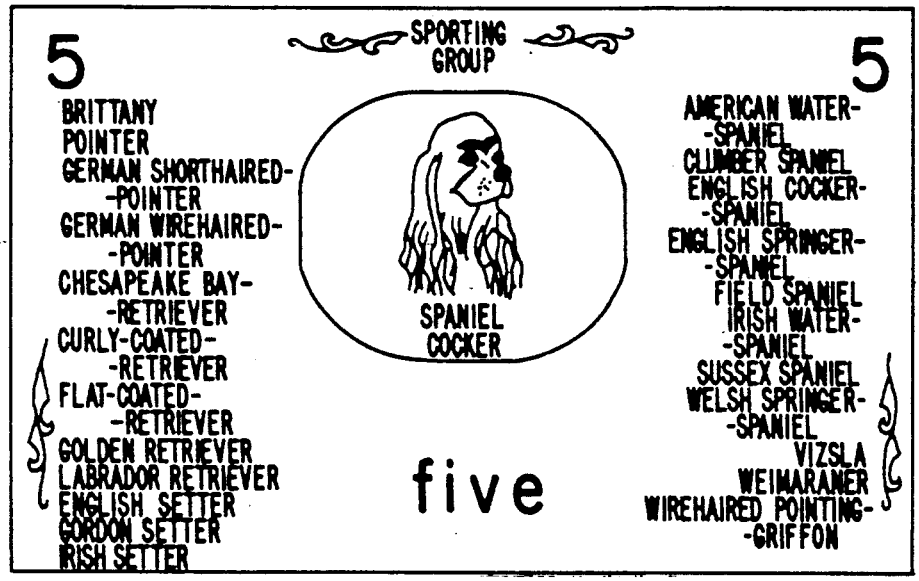
Figure 2G:
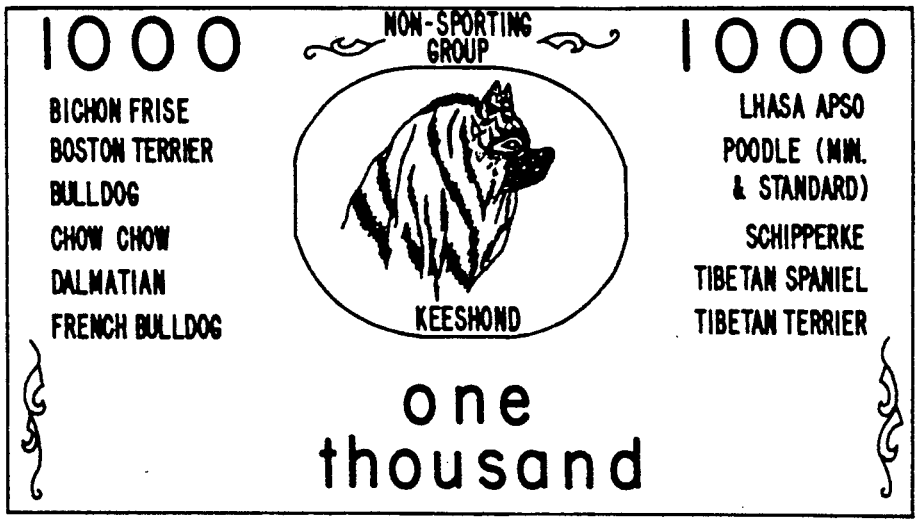

While the present invention is explained in the context of a dog show exhibition, those skilled in the art will appreciate that the teachings of the present invention may be readily applied to virtually any type of competitive sporting event.

Referring now to FIG. 1, the present invention contemplates the use of an event board 100 which portrays typical events which occur at an exhibition or in preparation for an exhibition. The event board 100 is organized in an hierarchical manner which simulates the process of elimination which occurs at a typical exhibition. For example, the first level of competition is represented by class ring 102 which represents the activities which occur at the lowest level of competition. In the case of dog shows, this level represents the competition in which dogs compete to obtain their championship. It is contemplated that icons (not shown) which represent various breeds advance around the game board based on a random criteria such as rolling dice.

Once a dog has completed its championship, it advances to the next level 104 which represents the activities in which a dog competes in breed and group competition. Once on level 104, the users advance around the event board collecting various wins until one user ultimately advances to the best in show level 106.

The event board 102 further includes fields 108 and 110 for storing fact cards which simulate various situations and occurrences which may occur at a dog show, are stored during play. Examples of these cards are shown in FIGS. 5A–5F.

Figure 3:
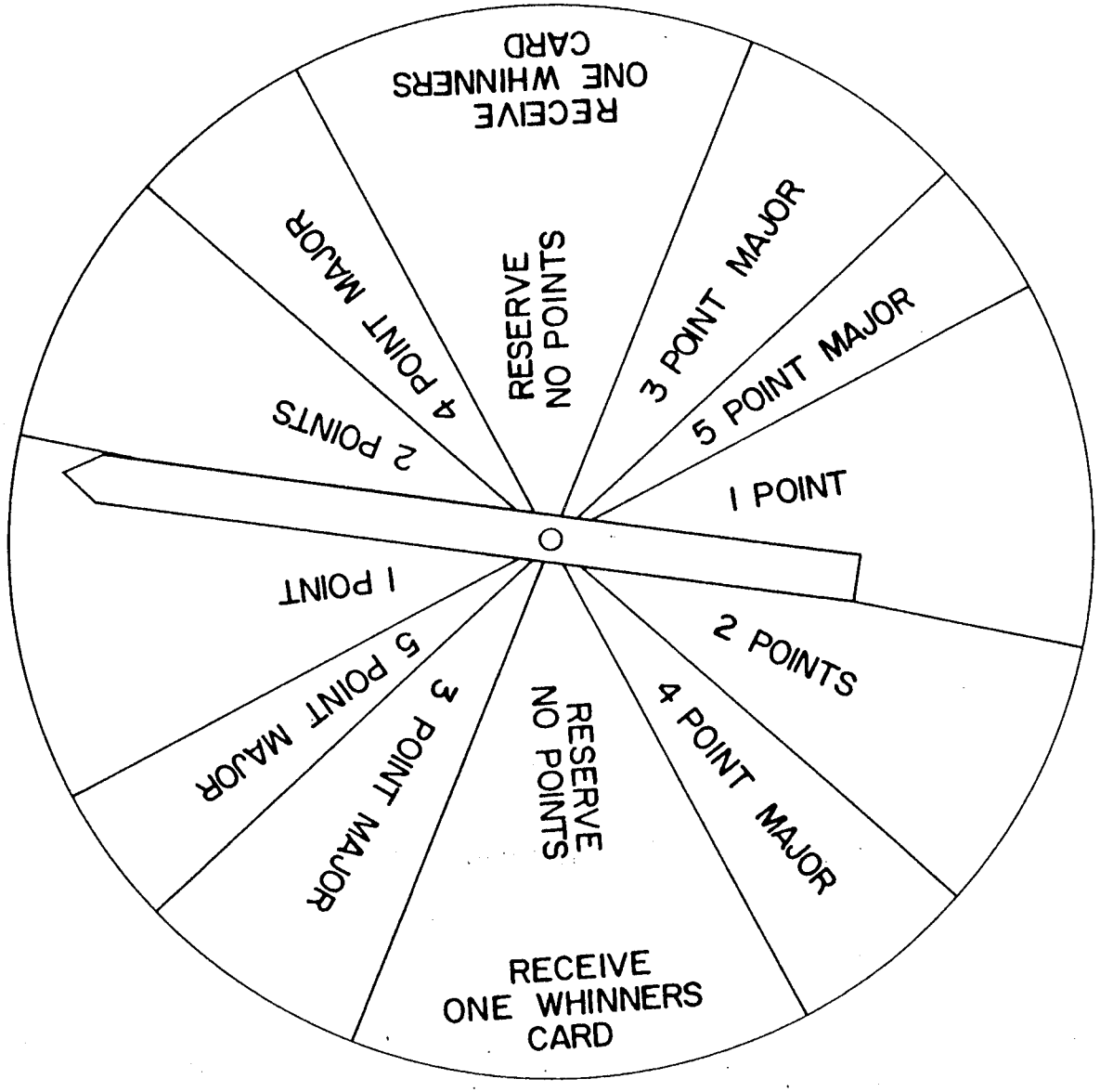
FIG. 3 is a diagram of the means used to simulate the chances of accumulating a particular number of points at a given event.
Figures 5C, 5D, 5E, 5F:
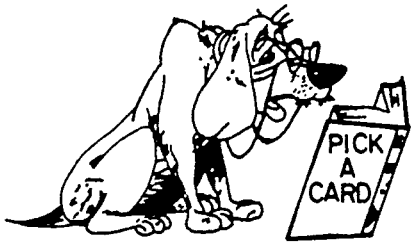

The class ring 102 contains events which simulate the pitfalls and potential successes one experiences when exhibiting animals. For example, events 112, 114 and 116 indicate that a user has entered a dog show. In real exhibitions, the actual outcome in terms of winning or in terms of the number of points received is random because many entries often do not appear. Therefore, whenever a user advances to a dog show field, the user will accumulate the number of points based on some random criteria. In the preferred practice of the present invention, a random criteria generator, such as the one shown in FIG. 3, is contemplated, wherein a user actuates a spinner to generate a random result.

Referring again to FIG. 1, events 118 and 120 indicate businesses available for purchase. Once a business has been purchased, other users landing on the respective services must hire the service for a fee. Event 122 indicates the user has acquired new livestock which may be sold at a later date. Events 124–128 indicate a user may acquire additional exhibition-quality livestock. Event 130 indicates the user's dog has been apprehended by the authorities, wherein the dog looses his license and is impounded for a period of time. In a similar manner, various true-life events are dispersed around the class ring 102 which simulate the pitfalls and successes which may be experienced at a dog show.

At the group level 104, the events simulate events which occur at a higher level of competition, such as winning a best-of-breed, as indicated by event 134, or attending a seminar as indicated by event 136. Event 138 represents joining a club related to the particular animal. The pinnacle of the competition is represented by event 106 which represents the highest level attainable in the competition.

In operation, the users select a suitable icon (not shown), such as a small dog piece in the case of a dog show to represent the user. In addition, each user selects a breed of dog to campaign. In the preferred practice of the present invention it is contemplated that the teaching apparatus includes a plurality of "breed cards," such as the breed cards of FIG. 6A–6D, wherein each of the breed cards includes a graphic representation of the selected breed and an educational description of the breed. This breed card is preferably kept by the user during the use of the present invention and may typically be displayed upright in a small stand (not shown) for others to see. Each icon begins at square 140, wherein each user is endowed with a sum of "money," for example, $2,185.00. In the preferred practice of the present invention, it is contemplated that the money is printed with useful educational information. For example, as shown in FIGS. 2A–2G, each denomination of money is used to represent a particular group of dog, e.g., toy, terrier, sporting, working, etc. On the face of the money, all the dogs which are members of that group are listed.

The respective icons advance around the event board 102 based on some random criteria which in the case of the present invention is generated by rolling dice. As each icon advances around the event board, they land on events such as the events mentioned above. When first landing on certain businesses, these businesses are available for purchase, after which, subsequent users must patronize the business if landing on that event. When landing on some events, e.g., event 122, the user's livestock inventory increases, wherein this livestock may be sold after passing square 140. When landing on this event, the user receives a "puppy card," such as the one shown in FIGS. 5A and 5B. Still other events such as event 142 require the user to select a card, such as the cards shown in FIGS. 5C–5F. These cards simulate occurrences which occur in the normal course of the exhibition process, such as purchasing insurance, requiring veterinary service, paying handling fees, etc.

In the case of landing on certain events, e.g., events 112, 114 or 116, the user is permitted to participate in an exhibition or dog show. The exhibition or dog show is simulated by paying an entry fee and by using the means for simulating the chances for accumulating points at the exhibition. In the preferred practice of the present invention, this means is preferably a spinner, as shown in FIG. 3. The accumulation of points is therefore a random event, as is the case at the actual exhibitions. This is because of the wide variety of variables which are at play at these exhibitions. In the event no points are awarded, the user selects a "whiner's card," represented in FIGS. 5G and 5H, to simulate the typical reaction of persons in this situation. The users continue to advance around the event board until their respective dogs have accumulated 15 points, at which time they become champions and are permitted to compete on a high level, e.g., level 104.

Once a user's icon or dog has achieved the appropriate number of points, they advance to level 104, once they have advanced the appropriate number of spaces, as determined by the random criteria. This simulates the structure of true exhibitions, wherein animals compete on a number of hierarchies based on their respective championship points. On level 104, once a user has accumulated a breed win, as represented by event 144 and a group win, as represented by group 146, they may advance to the "best in show" location 106, thus winning the competition.

In summary, an improved method and system for instructing individuals as to various breeds of animals and in the art of exhibition has been described. The present invention contemplates the use of an event board which simulates true life circumstances which occur while exhibiting. In addition, other devices are employed which instruct users as to various aspects of exhibition and of dog breeds, wherein these devices present the information in a manner which is most enjoyable to users. Accordingly, other uses and modifications of the present invention will be apparent to persons of ordinary skill without departing from the spirit and scope of the present invention, and all of such uses and modifications are intended to fall within the scope of the appended claims.

I claim:

1. A method of simulating an animal exhibition event with a board game said board game including a plurality of icons each of which represent a contestant in an exhibition, a plurality of fact cards which include comments heard at an exhibition and facts about the breeds of animals which participate in an exhibition and a playing board having first and second bands of contiguous fields and at least one central field, wherein some of said fields instruct a user to select one of said fact cards, some of said fields award points for winning an event at an exhibition based on a random point criteria and some of said fields represent the pitfalls and rewards experienced while preparing for and participating in an animal exhibition, said method comprising the steps of:

a) generating a random numerical value with a first random number generating means;

b) advancing said icons around said playing board a predetermined number of contiguous fields based on the numerical value generated by said random number generating means, wherein said contestant receives a fact card, or an event based on the field where said icon is advanced, said events comprising events which occur while preparing for or during a competition, including winning an event at a competition, wherein points are awarded for winning said event based on said random point criteria;

c) advancing said icons from said first band to said second band upon accumulating a predetermined number of said points to advance to a higher level of competition; and d) advancing from said second band to said central field to win said simulated competition wherein said central field may be entered upon said icon accessing a specific field which permits access to said central field.

2. The method of claim 1 wherein said random point criteria comprises a spinner.

3. The method of claim 1 wherein said fact cards include instructional facts about specific breeds of animals encountered at an animal exhibition.

4. The method of claim 1 wherein said fact cards include comments often heard during the course of an animal exhibition.

5. An animal exhibition simulator comprising:

a) a plurality of icons each of which depict contestants in an exhibition;

b) first means for generating a random numerical criteria;

c) a plurality of fact cards containing facts regarding various breeds or comments often heard at an exhibition;

d) a playing board having a plurality of contiguous fields forming first and second bands arranged in a concentric array and at least one central field, wherein each of said fields depict an event which occurs at an animal exhibition, including events of winning class events, events which occur during competition or while preparing for competition, and an instruction to the user to select one of said fact cards, wherein said icons are advanced around said bands based on said random numerical criteria, wherein said second band comprises an advanced level of competition and said central band represents the pinnacle of competition; and e) second means for generating a random criteria for points to be awarded upon winning said class events.

6. The animal exhibition simulator of claim 5, wherein said means for generating a random criteria comprise dice.

7. The animal exhibition simulator of claim 5, wherein said icons may advance from said first band to said second band only at specific locations on said playing board.

* * * * *